US007654248B2

(12) United States Patent
Buslepp et al.

(10) Patent No.: US 7,654,248 B2
(45) **Date of Patent: *Feb. 2, 2010**

(54) CYLINDER TORQUE BALANCING FOR INTERNAL COMBUSTION ENGINES

(75) Inventors: Kenneth J. Buslepp, Brighton, MI (US); Douglas R. Verner, Sterling Heights, MI (US); Randall J. Guild, Okemos, MI (US); David S. Mathews, Howell, MI (US); Todd R. Shupe, Milford, MI (US); Robert Douglas Shafto, New Hudson, MI (US); Kevin C. Wong, Ann Arbor, MI (US); Karen A. Blandino, Fenton, MI (US)

(73) Assignee: GM Global Technology Operations, Inc.

( * ) Notice: Subject to any disclaimer, the term of this patent is extended or adjusted under 35 U.S.C. 154(b) by 7 days.

This patent is subject to a terminal disclaimer.

(21) Appl. No.: 12/027,532

(22) Filed: Feb. 7, 2008

(65) Prior Publication Data

US 2008/0133111 A1 Jun. 5, 2008

Related U.S. Application Data

(63) Continuation-in-part of application No. 11/432,446, filed on May 11, 2006, now Pat. No. 7,500,470.

(60) Provisional application No. 60/964,438, filed on Aug. 10, 2007.

(51) Int. Cl.
*F02D 41/14* (2006.01)

(52) U.S. Cl. ..... 123/436; 123/673

(58) Field of Classification Search ..... 123/436, 123/673

See application file for complete search history.

(56) References Cited

U.S. PATENT DOCUMENTS

| | | | | |
|---|---|---|---|---|
| 3,789,816 | A * | 2/1974 | Taplin et al. | 123/436 |
| 4,993,389 | A * | 2/1991 | Ahlborn et al. | 123/436 |
| 5,701,865 | A * | 12/1997 | Thomas et al. | 123/339.11 |
| 5,720,260 | A * | 2/1998 | Meyer et al. | 123/436 |
| 5,906,652 | A * | 5/1999 | Remboski et al. | 701/110 |
| 5,950,599 | A * | 9/1999 | Rotramel et al. | 123/436 |
| 6,024,070 | A * | 2/2000 | May et al. | 123/406.25 |
| 6,209,519 | B1 * | 4/2001 | Melchior et al. | 123/406.24 |
| 6,993,427 | B2 * | 1/2006 | Ueda | 701/111 |
| 7,027,910 | B1 * | 4/2006 | Javaherian et al. | 701/111 |
| 7,455,048 | B2 * | 11/2008 | Maier-Landgrebe | 123/436 |
| 7,467,040 | B2 * | 12/2008 | Ker et al. | 701/102 |
| 2002/0092500 | A1 * | 7/2002 | Gaessler et al. | 123/435 |

OTHER PUBLICATIONS

U.S. Appl. No. 11/432,446, filed May 11, 2006, Kenneth Buslepp et al.

* cited by examiner

*Primary Examiner*—Erick Solis
(74) *Attorney, Agent, or Firm*—Harness, Dickey & Pierce, P.L.C.

(57) ABSTRACT

An engine torque control module comprises a derivative module and a cylinder torque module. The derivative module determines a derivative term for a first cylinder of an internal combustion engine based on rotation of a crankshaft and determines an average derivative term for the first cylinder based upon the derivative term. The cylinder torque module determines an operating condition of the first cylinder based on the average derivative term, adjusts a torque output of the first cylinder based on the operating condition, and adjusts a torque output of a second cylinder based on the operating condition.

28 Claims, 6 Drawing Sheets

CYLINDER TORQUE BALANCING FOR INTERNAL COMBUSTION ENGINES

CROSS-REFERENCE TO RELATED APPLICATIONS

This application claims the benefit of U.S. Provisional Application No. 60/964,438, filed on Aug. 10, 2007. This application is a continuation-in-part of U.S. patent application Ser. No. 11/432,446 filed on May 11, 2006. The disclosures of the above applications are incorporated herein by reference in its entirety

FIELD

The present invention relates to internal combustion engines, and more particularly to balancing torque across cylinders of an internal combustion engine.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines create drive torque that is transferred to a drivetrain via a crankshaft. More specifically, air is drawn into an Internal combustion engines create drive torque that is transferred to a drivetrain via a crankshaft. More specifically, air is drawn into an engine and is mixed with fuel therein. The air and fuel mixture is combusted within cylinders to drive pistons. The pistons drive the crankshaft, generating drive torque.

In some instances, the individual cylinders do not produce an equivalent amount of drive torque. That is to say, some cylinders can be weaker than others, resulting in a torque imbalance across the cylinders. Such torque imbalances can generate noticeable vibrations throughout the drivetrain and can even result in engine stall if severe enough. Although traditional torque balance systems identify and increase the torque output to a chronically weak cylinder, such system fail to account for the torque increase and fail to balance the torque output across all cylinders.

SUMMARY

An engine torque control module comprises a derivative module and a cylinder torque module. The derivative module determines a derivative term for a first cylinder of an internal combustion engine based on rotation of a crankshaft and determines an average derivative term for the first cylinder based upon the derivative term. The cylinder torque module determines an operating condition of the first cylinder based on the average derivative term, adjusts a torque output of the first cylinder based on the operating condition, and adjusts a torque output of a second cylinder based on the operating condition.

In further features, the cylinder torque module compares the average derivative term with a minimum threshold and determines that the operating condition of the first cylinder is strong when the average derivative term is less than the minimum threshold. The cylinder torque module adjusts the torque output of the first cylinder by decreasing the torque output of the first cylinder when the first cylinder is strong.

In still further features, the cylinder torque module increases the torque output of the second cylinder in correspondence with the torque output decrease of the first cylinder. The cylinder torque module decreases the torque output of the first cylinder by a decrease torque amount, increases the torque output of the second cylinder by a first increase torque amount, and increases a torque output of a third cylinder by a second increase torque amount, wherein a total of the first and second increase torque amounts corresponds to the decrease torque amount.

In other features, the cylinder torque module compares the average derivative term with a maximum threshold and determines that the operating condition of the first cylinder is weak when the average derivative term is greater than the maximum threshold. The cylinder torque module adjusts the torque output of the first cylinder by increasing the torque output of the first cylinder when the first cylinder is weak.

In further features, the cylinder torque module decreases the torque output of the second cylinder in correspondence with the torque output increase of the first cylinder. The cylinder torque module increases the torque output of the first cylinder by an increase torque amount, decreases the torque output of the second cylinder by a first decrease torque amount, and decreases a torque output of a third cylinder by a second decrease torque amount, wherein a total of the first and second decrease torque amounts corresponds to the increase torque amount.

In still further features, the derivative module comprises a first derivative module and a second derivative module. The first derivative module determines a first derivative term based on the rotation of the crankshaft. The second derivative module determines a second derivative term based on the first derivative term. The derivative module determines the average derivative term based on the first and second derivative terms.

In other features, the derivative module determines the average derivative term based on a first derivative term that is determined for the first cylinder, a second derivative term that is determined for the first cylinder, and another second derivative term that is determined for a recovery cylinder that is immediately after the first cylinder in a firing order.

In still other features, the cylinder torque module determines a spark timing based upon the average derivative term and adjusts the torque output of the first cylinder by adjusting the spark timing. The cylinder torque module determines the spark timing further based on a spark versus thermal efficiency curve of the engine. The cylinder torque module adjusts the torque output of the first cylinder by adjusting a fueling rate to the first cylinder.

A method of controlling torque comprises determining a derivative term for a first cylinder of an internal combustion engine based on rotation of a crankshaft, determining an average derivative term for the first cylinder based upon the derivative term, determining an operating condition of the first cylinder based on the average derivative term, adjusting a torque output of the first cylinder based on the operating condition, and adjusting a torque output of a second cylinder based on the operating condition.

In further features, the method further comprises comparing the average derivative term with a minimum threshold and determining that the operating condition of the first cylinder is strong when the average derivative term is less than the minimum threshold. The method further comprises adjusting the torque output of the first cylinder by decreasing the torque output of the first cylinder when the first cylinder is strong.

The method further comprises increasing the torque output of the second cylinder in correspondence with the torque output decrease of the first cylinder.

In still further features, the method further comprises decreasing the torque output of the first cylinder by a decrease torque amount, increasing the torque output of the second cylinder by a first increase torque amount, and increasing a torque output of a third cylinder by a second increase torque amount, wherein a total of the first and second increase torque amounts corresponds to the decrease torque amount.

In other features, the method further comprises comparing the average derivative term with a maximum threshold and determining that the operating condition of the first cylinder is weak when the average derivative term is greater than the maximum threshold. The method further comprises adjusting the torque output of the first cylinder by increasing the torque output of the first cylinder when the first cylinder is weak. The method further comprises decreasing the torque output of the second cylinder in correspondence with the torque output increase of the first cylinder.

In still other features, the method further comprises increasing the torque output of the first cylinder by an increase torque amount, decreasing the torque output of the second cylinder by a first decrease torque amount, and decreasing a torque output of a third cylinder by a second decrease torque amount, wherein a total of the first and second decrease torque amounts corresponds to the increase torque amount.

In further features, the method further comprises determining a first derivative term based on the rotation of the crankshaft, determining a second derivative term based on the first derivative term, and determining the average derivative term based on the first and second derivative terms. The method further comprises determining the average derivative term based on a first derivative term that is determined for the first cylinder, a second derivative term that is determined for the first cylinder, and another second derivative term that is determined for a recovery cylinder that is immediately after the first cylinder in a firing order.

In still further features, the method further comprises determining a spark timing based upon the average derivative term and adjusting the torque output of the first cylinder by adjusting the spark timing. The method further comprises determining the spark timing further based on a spark versus thermal efficiency curve of the engine. The method further comprises adjusting the torque output of the first cylinder by adjusting a fueling rate to the first cylinder.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The present invention will become more fully understood from the detailed description and the accompanying drawings, wherein.

DETAILED DESCRIPTION

Figure 1:
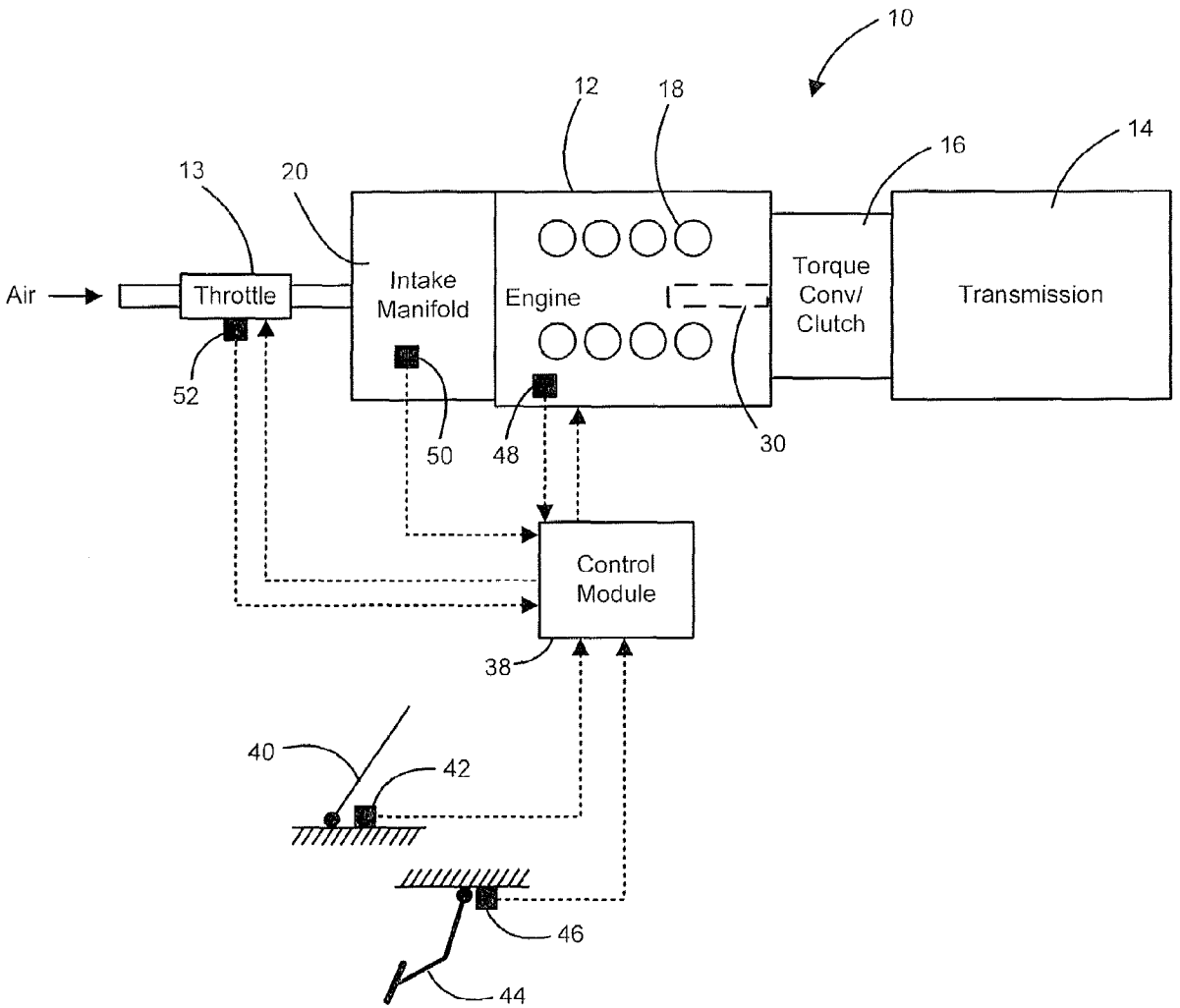
FIG. 1 is a functional block diagram illustrating an exemplary vehicle that is regulated based on the cylinder torque balancing control of the present invention.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

Referring now to FIG. 1, an exemplary vehicle 10 includes an engine 12 that drives a transmission 14. The transmission 14 is either an automatic or a manual transmission that is driven by the engine 12 through a corresponding torque converter or clutch 16. Air flows into the engine 12 through a throttle 13. The engine 12 includes N cylinders 18. Although FIG. 1 depicts eight cylinders (N=8), it is appreciated that the engine 12 may include additional or fewer cylinders 18. For example, engines having 4, 5, 6, 8, 10, 12 and 16 cylinders are contemplated. Air flows into the engine 12 through an intake manifold 20 and is combusted with fuel in the cylinders 18. The combustion process reciprocally drives pistons (not shown) within the cylinders 18. The pistons rotatably drive a crankshaft 30 to provide drive torque to the powertrain.

A control module 38 communicates with the engine 12 and various inputs and sensors as described herein. A vehicle operator manipulates an accelerator pedal 40 to regulate the throttle 13. More particularly, a pedal position sensor 42 generates a pedal position signal that is communicated to the control module 38. The control module 38 generates a throttle control signal based on the pedal position signal. A throttle actuator (not shown) adjusts the throttle 13 based on the throttle control signal to regulate airflow into the engine 12.

The vehicle operator manipulates a brake pedal 44 to regulate vehicle braking. More particularly, a brake position sensor 46 generates a brake pedal position signal that is communicated to the control module 38. The control module 38 generates a brake control signal based on the brake pedal position signal. A brake system (not shown) adjusts vehicle braking based on the brake control signal to regulate vehicle speed. An intake manifold absolute pressure (MAP) sensor 50 generates a signal based on a pressure of the intake manifold 20. A throttle position sensor (TPS) 52 generates a signal based on throttle position.

A crankshaft rotation sensor 48 generates a signal based on rotation of the crankshaft 30, which can be used to calculate engine speed. More specifically, the engine includes a crankshaft rotation mechanism (not shown), to which the crankshaft rotation sensor 48 is responsive. In one example, the crankshaft rotation mechanism includes a toothed wheel that is fixed for rotation with the crankshaft 30. The crankshaft rotation sensor 48 is responsive to the rising and falling edges of the teeth. An exemplary toothed wheel includes 58 teeth that are equally spaced about the circumference of the wheel, except in one location where two teeth are missing to provide a gap. Therefore, the gap accounts for approximately 12° of crankshaft rotation and each tooth accounts for approximately 6° of crankshaft rotation. The control module 38 determines the engine RPM based on the time it takes for a pre-determined number of teeth to pass.

The cylinder torque balancing control of the present invention identifies weak cylinders based on rotation of the crankshaft. Furthermore, the cylinder torque control identifies strong cylinders based upon the rotation of the crankshaft. The cylinder torque balancing control of the present invention balances the cylinder torque output across the cylinders. More specifically, the cylinder torque balancing control monitors the crankshaft signal generated by the crankshaft rotation sensor 48. The time it takes the crankshaft 30 to rotate a predetermined angle (e.g., 90° ) during the expansion stroke of a particular cylinder is provided as $t_{CS}$.

An average derivative term ($DT_{AVG}$) for each cylinder is calculated. $DT_{AVG}$ is determined based on first and second crankshaft speed derivatives FD and SD, respectively. More specifically, FD is determined for the monitored cylinder k−1 and is denoted $FD_{k-1}$. As used herein, k is the recovery cylinder, which fires after the monitored cylinder k−1 (i.e., the recovery cylinder is next in the firing order after the monitored cylinder). SD is determined for both the recovery cylinder (i.e., the currently firing cylinder) and the monitored cylinder, which are provided as $SD_k$ and $SD_{k-1}$, respectively. A derivative term (DT) for a particular cylinder is sampled over several engine cycles and $DT_{AVG}$ is determined as the average thereof.

If $DT_{AVG}$ of a particular cylinder exceeds a threshold ($DT_{THR}$), that cylinder is deemed weak. Accordingly, the torque output of the particular cylinder ($TQ_k$) is increased. Concurrently, the torque output of another cylinder or other cylinders is correspondingly decreased. That is to say, if the torque output of the weak cylinder is increased by X Nm, the torque output of another cylinder is decreased by X Nm. Alternatively, the torque output of each of a plurality of other cylinders can be decreased, whereby the total torque output decrease is equal to X Nm.

In another aspect of the present invention, the cylinder torque balancing control can actively balance the torque output of each cylinder with respect to the total torque output across the cylinders. More specifically, the cylinder torque balancing control monitors $DT_{AVG}$ for each cylinder and increases or decreases the torque output of the individual cylinders to balance $DT_{AVG}$ across the cylinders. $DT_{AVG}$ can be balanced so that it is approximately equal for all cylinders. Alternatively, $DT_{AVG}$ can be balanced so that each $DT_{AVG}$ is within a predetermined range. That is to say that $DT_{AVG}$ is within a range defined between a predetermined minimum DT ($DT_{MIN}$) and a predetermined maximum DT ($DT_{MAX}$). This range, between $DT_{MIN}$ and $DT_{MAX}$, may be referred to as a deadband region.

The cylinder torque balancing control determines an operating condition for each of the individual cylinders based upon a comparison of $DT_{AVG}$ for each cylinder with $DT_{MIN}$ and $DT_{MAX}$. For example only, if $DT_{AVG}$ of a particular cylinder falls within the deadband region (i.e., $DT_{MIN}<DT_{AVG}<DT_{MAX}$), the particular cylinder (k−1) may be the to be generating the appropriate amount of torque. Accordingly, the torque output of the particular cylinder $TQ_{k-1}$ may maintained at current levels (i.e., neither increased nor decreased).

If $DT_{AVG}$ of a particular cylinder exceeds the $DT_{MAX}$, the cylinder may be deemed weak, and the torque output of the cylinder $TQ_{k-1}$ is increased. Concurrently, the torque output of another cylinder or other cylinders may be correspondingly decreased. For example only, the torque output of the cylinders $TQ_k$ and $TQ_{k-2}$ may be decreased based upon the increase in torque output of the cylinder $TQ_{k-1}$.

If the $DT_{AVG}$ of the cylinder (k−1) is less than the $DT_{MIN}$, the cylinder may be deemed strong, and the torque output of the cylinder $TQ_{k-1}$ may be decreased. Concurrently, the torque output of another cylinder or other cylinders is correspondingly increased. For example only, the torque output of the cylinders $TQ_k$ and $TQ_{k-2}$ may be increased based upon the decrease in torque output of the cylinder $TQ_{k-1}$.

The torque output of the individual cylinders can be regulated by adjusting the spark timing of the particular cylinder. More specifically, the spark timing can be retarded or advanced to respectively decrease and increase the torque output of the particular cylinder. The spark versus thermal efficiency curve for the particular engine can be implemented to determine the spark adjustment to achieve the desired torque adjustment. If an engine exhibits a steep relationship of spark timing to thermal efficiency, a pure spark correction will vary in delivered torque as a function of the base spark timing. For example, the torque versus spark timing slope is different at 8° base spark timing when compared to 15° timing. In the case of a diesel engine, the torque output can be regulated by adjusting the fueling to the particular cylinder, whereby the fuel to torque relationship is used to determine the fuel adjustment required to achieve the desired torque change.

Figure 2:
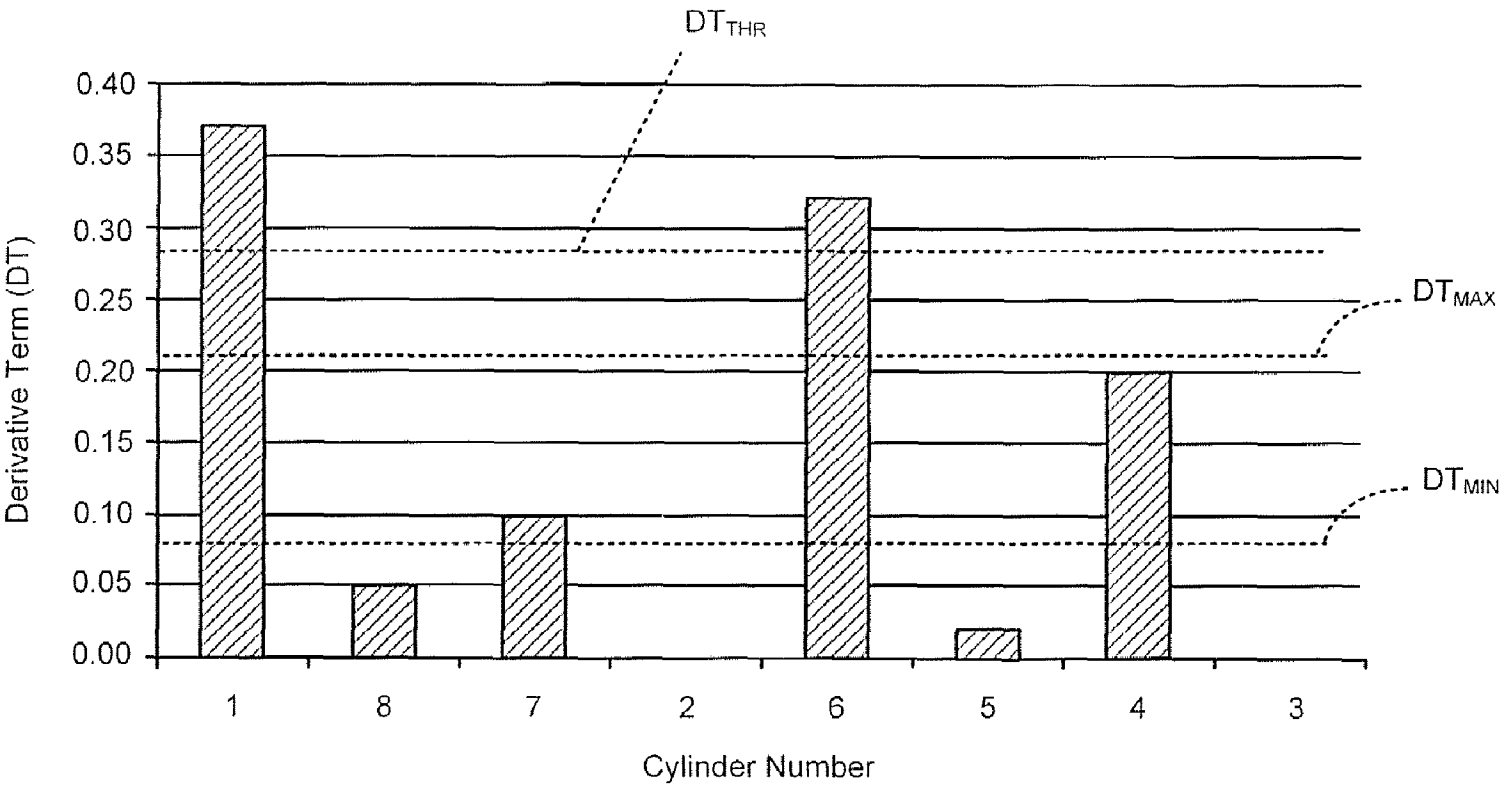
FIG. 2 is a graph illustrating exemplary derivative term magnitudes for cylinders of the exemplary engine system of FIG. 1, which are determined based on the cylinder torque balancing control of the present invention.

Referring now to FIG. 2, a graph illustrates exemplary $DT_{AVG}$ traces for cylinders in an 8-cylinder engine. It should be noted that the cylinder numbers (CN) along the x-axis are listed in their firing order. For example, if CN6 is the currently monitored cylinder k−1, CN2 is the previously fired cylinder k−2 and CN5 is the next firing or recovery cylinder k. As illustrated, $DT_{AVG}$ for CN6 exceeds $DT_{MAX}$. Accordingly, the torque output of CN6 is increased and the torque output of a corresponding cylinder or cylinders (i.e., adjacent cylinder or cylinders in the firing order) is correspondingly decreased during the subsequent engine cycle. For example, the torque output of either CN2 or CN5 can be decreased. Alternatively, the total torque output of CN2 and CN5 can be decreased. In this case, the torque output of CN2 can be decreased by a greater amount than the torque output of CN5 because $DT_{AVG}$ for CN5 is greater.

Furthermore, if CN5 is the currently monitored cylinder k−1, CN6 is the previously fired cylinder k−2 and CN4 is the next firing or recovery cylinder k. As illustrated, $DT_{AVG}$ for CN5 is less than $DT_{MIN}$. Accordingly, the torque output of CN5 is decreased and the torque output of a corresponding cylinder or cylinders (i.e., adjacent cylinder or cylinders in the firing order) may be correspondingly increased during the subsequent engine cycle. For example, the torque output of either CN6 or CN4 can be increased. Alternatively, the total torque output of CN6 and CN4 can be increased. In this case, the torque output of CN6 can be increased by a greater amount than the torque output of CN4 because $DT_{AVG}$ for CN6 is greater.

Figure 3:
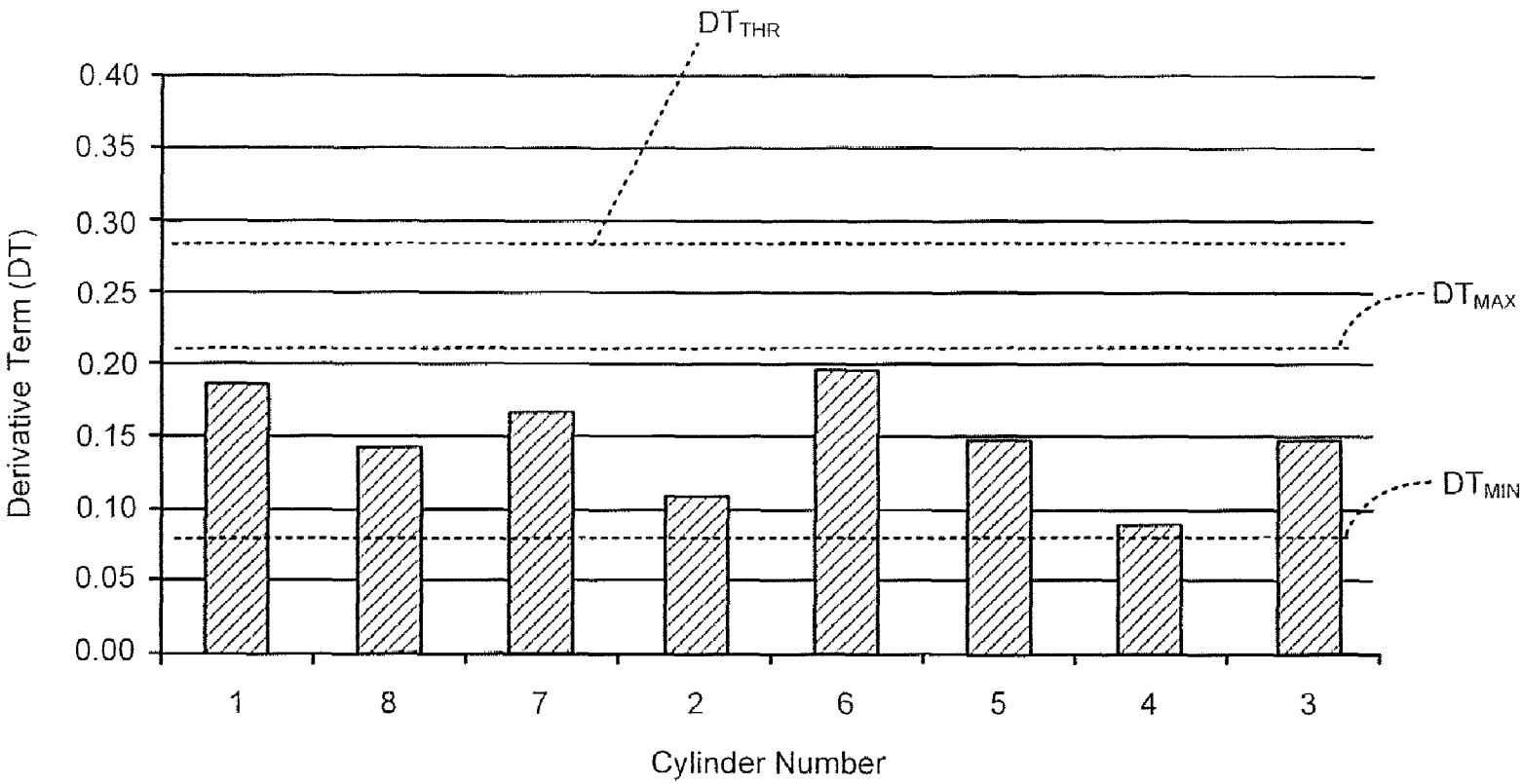
FIG. 3 is a graph illustrating active balancing of the torque output across the cylinders based on the derivative term magnitudes.

Referring now to FIG. 3, a graph illustrates active balancing of the torque output of the cylinder with respect to the total torque output across the cylinders. As illustrated, $DT_{AVG}$ for each cylinder is balanced so that it is within the deadband region defined between $DT_{MIN}$ and $DT_{MAX}$. $DT_{MAX}$ is established to be sufficiently below $DT_{THR}$.

Figure 4A:
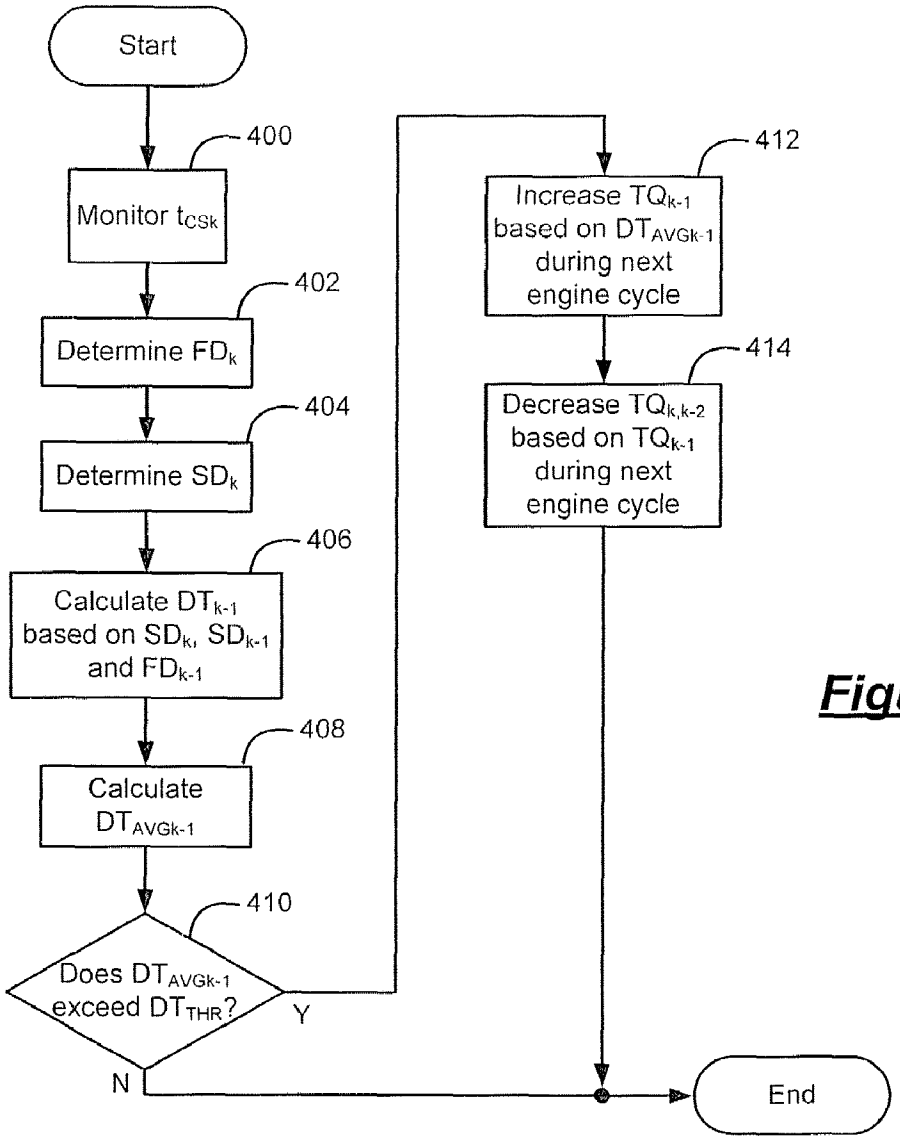
FIGS. 4A-B are flowcharts illustrating exemplary steps executed by the cylinder torque balancing control of the present invention.

Referring now to FIG. 4A, exemplary steps executed by the cylinder torque balancing control will be described in detail. In step 400, control monitors $t_{CSk}$ for the recovery cylinder. In steps 402 and 404, control determines $FD_k$ and $SD_k$, respectively. Control determines $DT_{k-1}$ (i.e., for the monitored cylinder) based on $SD_k$, $SD_{k-1}$ and $FD_{k-1}$, in step 406. $SD_{k-1}$ and $FD_{k-1}$ are provided from a buffer and are determined in a previous iteration. In step 408, control determines $DT_{AVGk-1}$ (i.e., $DT_{AVG}$ for the monitored cylinder k−1) based on $DT_{k-1}$.

In step 410, control determines whether $DT_{AVGk-1}$ (i.e., for the currently firing cylinder) exceeds $DT_{THR}$. If $DT_{AVGk-1}$ does not exceed $DT_{THR}$, control ends. If $DT_{AVGk-1}$ exceeds $DT_{THR}$, control increases $TQ_{k-1}$ based on $DT_{AVGk-1}$ during the next firing event for the monitored cylinder k−1 in step 412. In step 414, control increases TQ for either or both of the previous firing cylinder k−2 and the recovery cylinder k based on the increase to $TQ_{k-1}$ and control ends.

Figure 4B:
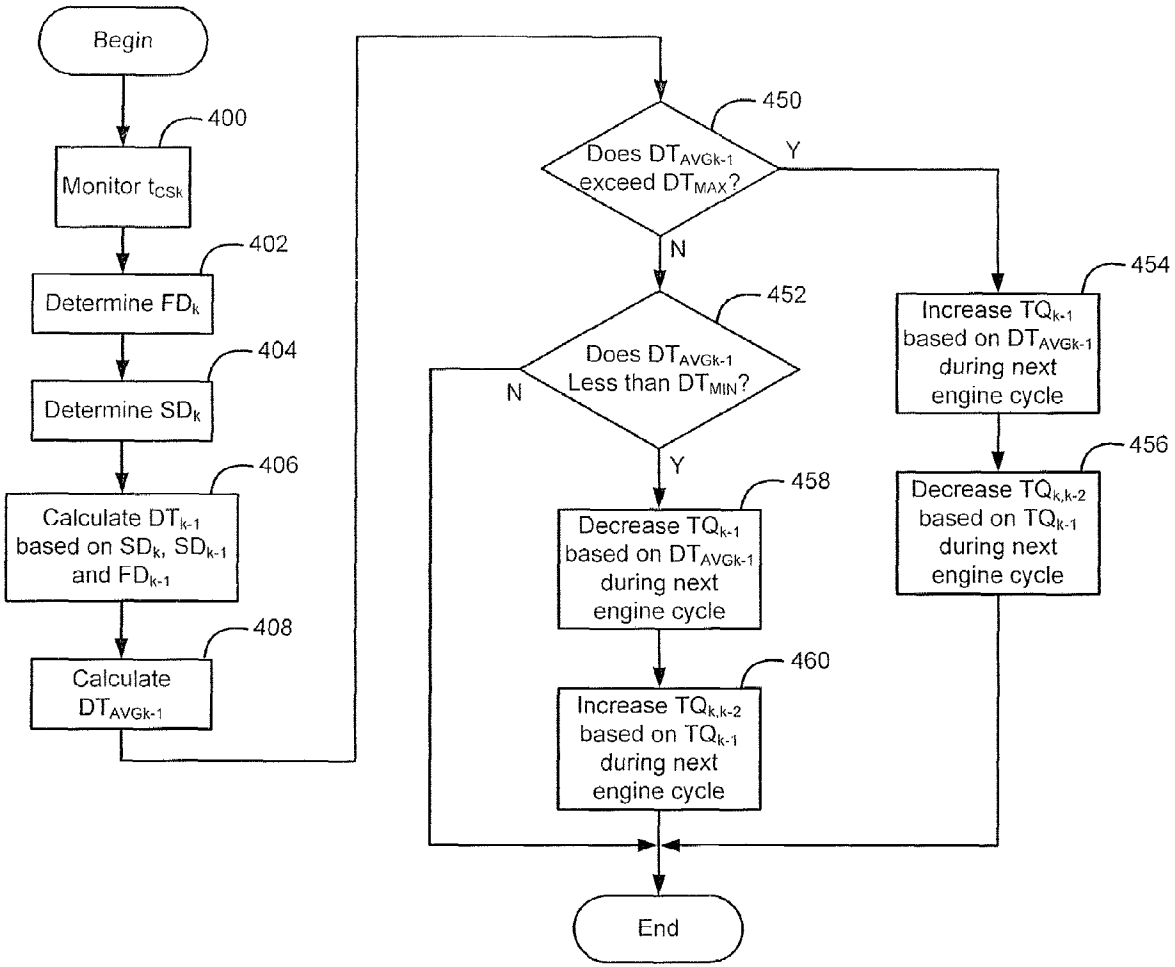

Referring now to FIG. 4B, exemplary steps executed by the cylinder torque balancing control will be described in detail. The exemplary cylinder torque balancing control of FIG. 4B performs steps 400-408 of FIG. 4A. Then, in step 450, control determines whether $DT_{AVGk-1}$ (i.e., for the monitored cylinder) exceeds $DT_{MAX}$. If $DT_{AVGk-1}$ does not exceed $DT_{MAX}$, control continues in step 452.

If $DT_{AVGk-1}$ exceeds $DT_{MAX}$, control increases $TQ_{k-1}$ based on $DT_{AVGk-1}$ during the next firing event for the monitored cylinder k−1 in step 454. In step 456, control may decrease TQ for either or both of the previous firing cylinder k−2 and the recovery cylinder k based on the increase to $TQ_{k-1}$. Control then ends.

In step 452, control determines whether $DT_{AVGk-1}$ (i.e., for the monitored cylinder) is less than $DT_{MIN}$. If $DT_{AVGk-1}$ is less than $DT_{MIN}$, control continues in step 458. If $DT_{AVGk-1}$ is not less than $DT_{MIN}$, control then ends. Control ends because $DT_{AVGk-1}$ is within the deadband region (i.e., $DT_{MIN}<DT_{AVGk-1}<DT_{MAX}$). In step 458, control decreases $TQ_{k-1}$ based on $DT_{AVGk-1}$ during the next firing event for the monitored cylinder k−1. In step 460, control may increase TQ for either or both of the previous firing cylinder k−2 and the recovery cylinder k based on the decrease to $TQ_{k-1}$. Control then ends.

Figure 5:
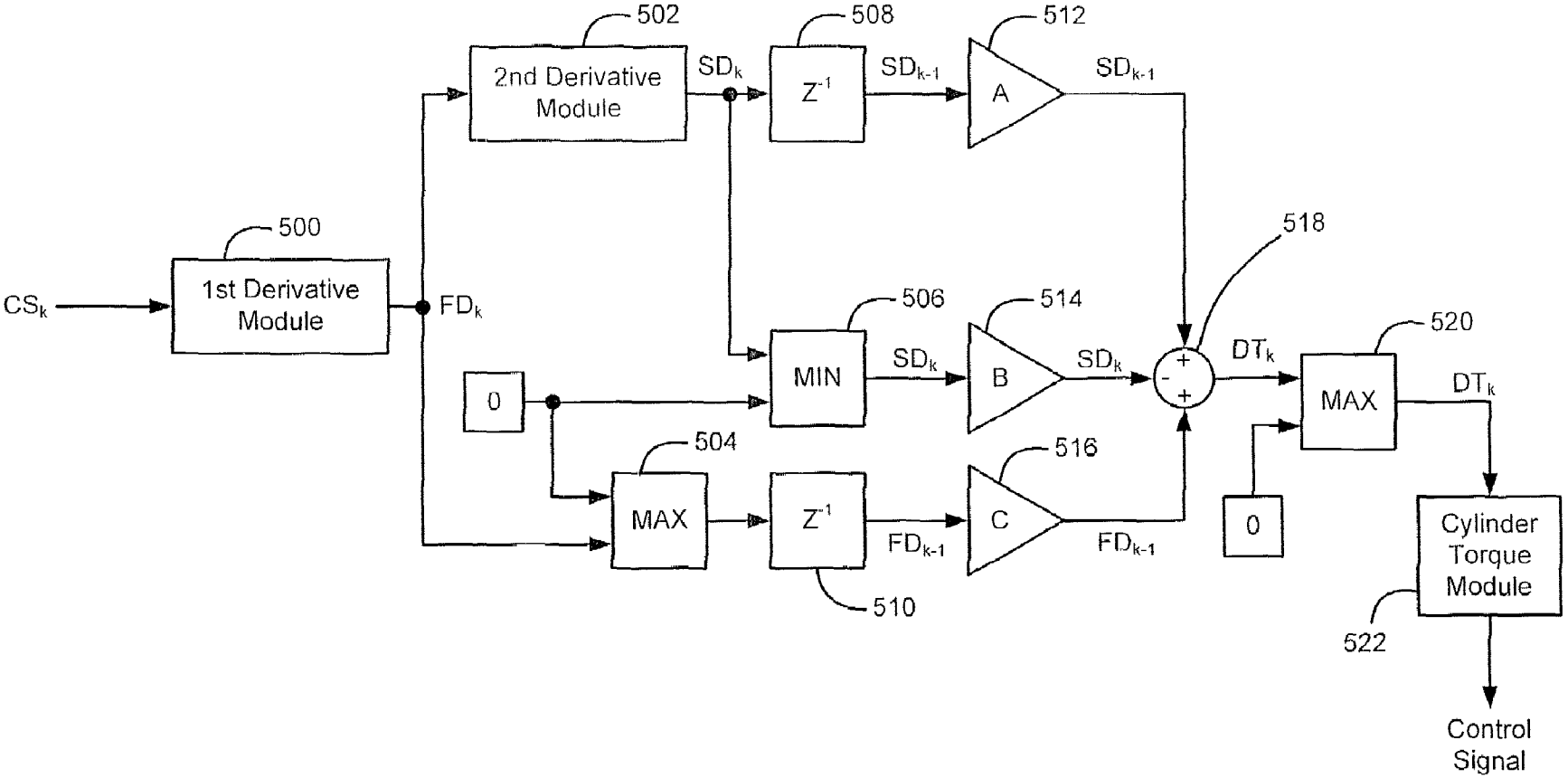
FIG. 5 is a functional block diagram illustrating exemplary modules that execute the cylinder torque balancing control of the present invention.

Referring now to FIG. 5, exemplary modules that execute the cylinder torque balancing control will be described in detail. The exemplary modules include first and second derivative modules 500, 502, maximum and minimum modules 504, 506, buffer modules 508, 510, gain modules 512, 514, 516, a summer 518, a maximum module 520 and a cylinder torque module 522. The first derivative module 500 receives $t_{CSk}$ and determines $FD_k$ based thereon. $FD_k$ is output to the second derivative module 502 and the maximum module 504. The second derivative module 502 determines $SD_k$ based on $FD_k$ and outputs $SD_k$ to the minimum module 506 and the buffer module 508.

The maximum module 504 clamps $FD_k$ and the minimum module 506 clamps $SD_k$ to minimize noise. The buffer modules 508, 510 output $SD_{k-1}$ and $FD_{k-1}$ to the gain modules 512, 516, respectively, and the minimum module 506 outputs $SD_k$ to the gain module 514. The gain modules 512, 514, 516 multiply $SD_{k-1}$, $SD_k$ and $FD_{k-1}$ by respective gains A, B and C. The gains can be used to adjust the influence or weight of a particular derivative (i.e., $SD_{k-1}$, $SD_k$ and $FD_{k-1}$) or to turn OFF a derivative (e.g., gain set equal to 0).

The summer 518 sums $FD_{k-1}$ and $SD_{k-1}$ and subtracts $SD_k$ to provide $DT_{k-1}$. $DT_{k-1}$ is output to the maximum module 520, which clamps $DT_{k-1}$ to minimize noise. $DT_{k-1}$ is output to the cylinder torque module 522, which calculates $DT_{AVG}$ for each cylinder and generates control signals to regulate the torque output of the individual cylinders.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. An engine torque control module comprising:

a derivative module that determines a derivative term for a first cylinder of an internal combustion engine based on rotation of a crankshaft and that determines an average derivative term for said first cylinder based upon said derivative term; and a cylinder torque module that determines an operating condition of said first cylinder based on said average derivative term, that adjusts a torque output of said first cylinder based on said operating condition, and that adjusts a torque output of a second cylinder based on said operating condition.

2. The engine torque control module of claim 1 wherein said cylinder torque module compares said average derivative term with a minimum threshold and determines that said operating condition of said first cylinder is strong when said average derivative term is less than said minimum threshold.

3. The engine torque control module of claim 2 wherein said cylinder torque module adjusts said torque output of said first cylinder by decreasing said torque output of said first cylinder when said first cylinder is strong.

4. The engine torque control module of claim 3 wherein said cylinder torque module increases said torque output of said second cylinder in correspondence with said torque output decrease of said first cylinder.

5. The engine torque control module of claim 2 wherein said cylinder torque module decreases said torque output of said first cylinder by a decrease torque amount, increases said torque output of said second cylinder by a first increase torque amount, and increases a torque output of a third cylinder by a second increase torque amount, wherein a total of said first and second increase torque amounts corresponds to said decrease torque amount.

6. The engine torque control module of claim 1 wherein said cylinder torque module compares said average derivative term with a maximum threshold and determines that said operating condition of said first cylinder is weak when said average derivative term is greater than said maximum threshold.

7. The engine torque control module of claim 6 wherein said cylinder torque module adjusts said torque output of said first cylinder by increasing said torque output of said first cylinder when said first cylinder is weak.

8. The engine torque control module of claim 7 wherein said cylinder torque module decreases said torque output of said second cylinder in correspondence with said torque output increase of said first cylinder.

9. The engine torque control module of claim 6 wherein said cylinder torque module increases said torque output of said first cylinder by an increase torque amount, decreases said torque output of said second cylinder by a first decrease torque amount, and decreases a torque output of a third cylinder by a second decrease torque amount, wherein a total of said first and second decrease torque amounts corresponds to said increase torque amount.

10. The engine torque control module of claim 1 wherein said derivative module comprises:

a first derivative module that determines a first derivative term based on said rotation of said crankshaft; and a second derivative module that determines a second derivative term based on said first derivative term, wherein said derivative module determines said average derivative term based on said first and second derivative terms.

11. The engine torque control module of claim 1 wherein said derivative module determines said average derivative term based on a first derivative term that is determined for said first cylinder, a second derivative term that is determined for said first cylinder, and another second derivative term that is determined for a recovery cylinder that is immediately after said first cylinder in a firing order.

12. The engine torque control module of claim 1 wherein said cylinder torque module determines a spark timing based upon said average derivative term and adjusts said torque output of said first cylinder by adjusting said spark timing.

13. The engine torque control module of claim 12 wherein said cylinder torque module determines said spark timing further based on a spark versus thermal efficiency curve of said engine.

14. The engine torque control module of claim 1 wherein said cylinder torque module adjusts said torque output of said first cylinder by adjusting a fueling rate to said first cylinder.

15. A method of controlling torque comprising:

determining a derivative term for a first cylinder of an internal combustion engine based on rotation of a crankshaft;

determining an average derivative term for said first cylinder based upon said derivative term;

determining an operating condition of said first cylinder based on said average derivative term;

adjusting a torque output of said first cylinder based on said operating condition; and adjusting a torque output of a second cylinder based on said operating condition.

16. The method of claim 15 further comprising:

comparing said average derivative term with a minimum threshold; and determining that said operating condition of said first cylinder is strong when said average derivative term is less than said minimum threshold.

17. The method of claim 16 further comprising adjusting said torque output of said first cylinder by decreasing said torque output of said first cylinder when said first cylinder is strong.

18. The method of claim 17 further comprising increasing said torque output of said second cylinder in correspondence with said torque output decrease of said first cylinder.

19. The method of claim 16 further comprising:

decreasing said torque output of said first cylinder by a decrease torque amount;

increasing said torque output of said second cylinder by a first increase torque amount; and increasing a torque output of a third cylinder by a second increase torque amount, wherein a total of said first and second increase torque amounts corresponds to said decrease torque amount.

20. The method of claim 15 further comprising:

comparing said average derivative term with a maximum threshold; and determining that said operating condition of said first cylinder is weak when said average derivative term is greater than said maximum threshold.

21. The method of claim 20 further comprising adjusting said torque output of said first cylinder by increasing said torque output of said first cylinder when said first cylinder is weak.

22. The method of claim 21 further comprising decreasing said torque output of said second cylinder in correspondence with said torque output increase of said first cylinder.

23. The method of claim 20 further comprising:

increasing said torque output of said first cylinder by an increase torque amount;

decreasing said torque output of said second cylinder by a first decrease torque amount; and decreasing a torque output of a third cylinder by a second decrease torque amount, wherein a total of said first and second decrease torque amounts corresponds to said increase torque amount.

24. The method of claim 15 further comprising:

determining a first derivative term based on said rotation of said crankshaft;

determining a second derivative term based on said first derivative term; and determining said average derivative term based on said first and second derivative terms.

25. The method of claim 15 further comprising determining said average derivative term based on a first derivative term that is determined for said first cylinder, a second derivative term that is determined for said first cylinder, and another second derivative term that is determined for a recovery cylinder that is immediately after said first cylinder in a firing order.

26. The method of claim 15 further comprising:

determining a spark timing based upon said average derivative term; and adjusting said torque output of said first cylinder by adjusting said spark timing.

27. The method of claim 26 further comprising determining said spark timing further based on a spark versus thermal efficiency curve of said engine.

28. The method of claim 15 further comprising adjusting said torque output of said first cylinder by adjusting a fueling rate to said first cylinder.

* * * * *